US006300028B1

(12) United States Patent
Graham et al.

(10) Patent No.: US 6,300,028 B1
(45) **Date of Patent: *Oct. 9, 2001**

(54) ENVIRONMENTALLY STABLE AMORPHOUS SILICON PHOTORECEPTOR AND METHOD FOR MAKING SAME

(75) Inventors: Marshall Donnie Graham, Nicholasville, KY (US); Gary L. Dorer, Taunton, MA (US)

(73) Assignee: Coulter International Corp., Miami, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/048,149

(22) Filed: Mar. 25, 1998

(51) Int. Cl.[7] ..... G03G 5/147

(52) U.S. Cl. ..... 430/66; 430/67; 430/130; 430/132

(58) Field of Search ..... 430/67, 132, 66, 430/130, 57.4

(56) References Cited

U.S. PATENT DOCUMENTS

| | | | | |
|---|---|---|---|---|
| 4,025,339 | | 5/1977 | Kuehnle | 96/1.5 |
| 4,265,991 | | 5/1981 | Hirai et al. | 430/64 |
| 4,269,919 | | 5/1981 | Kuehnle | 430/67 |
| 4,358,195 | | 11/1982 | Kuehnle et al. | 355/4 |
| 4,472,492 | * | 9/1984 | Kanbe et al. | 430/130 |
| 4,556,309 | | 12/1985 | Weber et al. | 355/3 |
| 5,073,466 | * | 12/1991 | Ishikawa et al. | 430/66 |
| 5,561,021 | * | 10/1996 | Yamazaki et al. | 430/67 |

FOREIGN PATENT DOCUMENTS

| | | | | |
|---|---|---|---|---|
| 54-155046 | * | 12/1979 | (JP) | 430/130 |
| 59-170844 | * | 9/1984 | (JP) | 430/130 |

OTHER PUBLICATIONS

Kakkad, R. et al. "Crystallized Si Films by Low–temperature Rapid Thermal Annealing of Amorphous Silicon" J. Appl. Phys. 65 (5) pp. 2069–2072, Mar. 1989.*

* cited by examiner

*Primary Examiner*—Christopher Rodee
(74) *Attorney, Agent, or Firm*—Mitchell E. Alter

(57) ABSTRACT

The present invention provides an improved a-Si:H photoreceptor comprising a-Si:H photoconductors and conductive substrates, such as metallic members or plastic members provided with a metallic or an ohmic layer, in which degrading effects of the ambient environment on the electrophotographic properties of the a-Si:H photoconductor is minimized.

The present invention also provides a cost-effective method of forming the improved a-Si:H photoreceptors. The method comprises stabilizing an a-Si:H photoreceptor member against environmental degradation of its photoconductive properties, by modifying the working surface of the photoconductor through treatment with a silanol solution. The clean annealed photoreceptor is preferably exposed to a freshly prepared aqueous mixture of an organosilane hydrolyzable to yield a silanol solution. The photoreceptor is then rinsed with water to remove vagrant oligomers formed during condensation of the silanol prepolymers but unattached to surface sites on the photoconductor. The photoreceptor is then heat-treated to convert the hydrogen bonds between resident silanols and hydroxy groups on the photoconductor surface into covalent siloxane linkages, with formation of an alkylsilicone and evolution of water. The photoreceptor may be treated with the silanol solution either before or after use in imaging processes, and if desired, it can be retreated with the silanol solution.

8 Claims, 6 Drawing Sheets

SURFACE TREATED

35%
Relative Humidity

NON-TREATED

35%
Relative Humidity

SURFACE TREATED

50%
Relative Humidity

NON-TREATED

50%
Relative Humidity

SURFACE TREATED

70%
Relative Humidity

NON-TREATED

70%
Relative Humidity

ENVIRONMENTALLY STABLE AMORPHOUS SILICON PHOTORECEPTOR AND METHOD FOR MAKING SAME

CROSS-REFERENCE TO RELATED APPLICATION

Reference is made to the concurrently filed, commonly assigned, U.S. patent application Ser. No. 09/047,787, now U.S. Pat. No. 6,197,471 entitled "AN IMPROVED AMORPHOUS SILICON PHOTORECEPTOR AND METHOD OF MAKING SAME".

BACKGROUND OF THE INVENTION

1. Field of the Invention

The present invention relates generally to electrophotographic image-forming members or photoreceptors comprising hydrogenated amorphous silicon (a-Si:H) formed onto a supporting conductive substrate. More particularly, this invention is directed to an environmentally stabilized a-Si:H photoreceptor and a method of forming the stabilized photoreceptor.

2. Discussion of the Prior Art

Electrophotography is a well-known image transduction art depending on the formation of an electrostatic latent image on a charge-sensitized photoconductor formed onto a suitable substrate. The latent image is typically produced by photo-induced discharge of the photoconductor in response to a light image projected onto the working surface of the photoconductor, and a visual image for transfer to the hard-copy medium is developed from the latent image by contacting it with charge-sensitive toner particles. The toned image is then the basis for a variety of further imaging processes. The versatility of electrophotography has permitted its application in systems for copying, duplicating, printing, plate making and color proofing, among others, and electrophotography is increasingly being applied in computer output devices in which lasers are used to produce the latent image. Commercial potential of such systems is directly affected by the performance and producibility of the photoconductor. Generally, the photoconductor must have good charge acceptance $V_0$ and a long dark decay $\tau_D$, typically 10 to 20 seconds at minimum. In addition, fast photo-induced discharge is required, and the spectral response of the photoconductor must be compatible with the source. In critical applications, photoconductor fatigue or residual voltage may be limiting.

Considerable effort has been expended in development of prior-art photoconductors based on inorganic materials such as cadmium sulfide, zinc oxide, or selenium, as well as organic materials such as TNF-PVCz (the reaction product of 2,4,7-trinitro-9-fluorenone and poly-9-vinylcarbazole). Some prior-art photoconductors suffer well-known disadvantages such as low charge acceptance or short dark decays, poor thermal or environmental stability, poor mechanical strength or durability, or the potential for environmental contamination. Further, others lack good adhesion properties or are otherwise incompatible with use of flexible substrates required by large-format applications such as color proofing. In addition, many require formation temperatures too high to permit their use with plastic substrates.

High-quality, large-format electrophotography can be practiced through use of microcrystalline cadmium sulfide deposited onto thin conductive substrates (U.S. Pat. Nos. 4,025,339 and 4,269,919). A metallic member, or a plastic member coated with a metallic or an ohmic layer, may form such conductive substrate. Sputtered to thicknesses of 0.3 to 5 micra onto stainless-steel roll-stock up to one meter wide and about 0.1 mm thick, such anisotropic photoconductors have been adapted to provide flexible photoreceptors for an analog color-proofing application (U.S. Pat. Nos. 4,358,195 and 4,556,309) This application required that a latent image be retained almost two minutes between photoreceptor charging and development. The large-format (approximately 50 cm by 60 cm ) photoreceptors were required to be reusable for thousands of operational cycles. During operation, at 105 seconds after corona charging these thin cadmium sulfide photoconductors demonstrate typical surface potentials $V_{105}$=22 volts, they have linear photo-induced discharge, and they yield substantially zero residual voltage on complete discharge. When used with optimized liquid toner systems, these flexible low-voltage photoreceptors provide high-resolution four-color proofs. However, a potential environmental hazard due to manufacture or disposal of the cadmium sulfide photoconductor remains a concern.

The disadvantages of prior-art photoconductors has prompted investigation of amorphous silicon (a-Si) as the photosensitive material for use in electrophotographic photoreceptors. Amorphous silicon poses no environmental hazard and has good mechanical strength, adhesion, and durability, but demonstrates undesirable characteristics thought to originate in unsatisfied (or dangling) bonds in the silicon matrix. It has been shown that formation of amorphous silicon in presence of hydrogen provides a material (a-Si:H) with fewer dangling bonds and improved characteristics, the greatest improvement occurring for deposition substrate temperatures of approximately 230° C.

An extensive art based on a-Si:H materials has developed in the field of solar-energy conversion, in which thin a-Si:H layers are routinely deposited onto large-area flexible substrates the internal resistance of such photovoltaic devices must be as low as possible (of the order of 100 ohms) for attractive power outputs, but the corresponding volume resistivities (about $10^6$ ohm·cm) result in photoconductive properties ill-suited to electrophotographic applications. Other a-Si:H materials made to have higher resistivities exhibit attractive photoconductive properties, and by appropriate doping, such a-Si:H photoconductors can be made to accept positive charging, negative charging, or charging in either polarity. However, conventional a-Si:H photoreceptors are typically directed toward rapid-imaging systems for office use, the toner systems for which may require surface potentials of 100 volts or greater but the operational cycles for which seldom require dark decays longer than a few seconds. Consequently, the prior-art a-Si:H photoreceptors (e.g., U.S. Pat. No. 4,265,991) have demonstrated several characteristics which limit their usefulness as low-voltage electrophotographic photoreceptors. Included are the following significant disadvantages:

1. The low dark volume-resistivity (about $10^{10}$ ohm·cm) of such a-Si:H photoconductors, and their resultant fast dark decays, require deposition of a high-voltage a-Si:H layer at least 10 (and usually 20 to 50 micra in thickness to achieve the surface potentials needed by many electrophotographic processes at toning these thick photoconductive layers are both expensive to produce and poorly adapted to use with flexible substrates. As is known in the art, long dark decays require that a photoconductor have both a wide optical bandgap, which indicates a low density of thermally generated charge carriers, and a low drift mobility for such carriers. The optical bandgap of a-Si:H is known to increase with increasing hydrogen content, up to about 10% total hydrogen, and carrier mobilities in a-Si:H are known to decrease with addition of small amounts of neutral dopants such as oxygen or nitrogen. However, prior-art a-Si:H photoconductors based on either bandgap widening by hydrogen enrichment or mobility suppression by doping-induced trapping enhancement demonstrate degraded photoconductive properties and spatial inhomogeneities in the charge acceptance or toning response. In addition, the bulk properties of prior-art a-Si:H photoconductors are adversely affected by interface processes. When prior-art a-Si:H photoconductors are used in bilayer photoreceptors, carrier injection from the conductive substrate or charge transfer from the environment accelerates bulk dark-decay processes, further reducing applicability of such photoreceptors. Such processes have been partially overcome in the prior art by fabrication of multilayered photoreceptors in which thin (a few hundred nm or less) insulating layers are either deposited at the interface between the a-Si:H photoconductor and the conductive substrate, or topcoated over the photoconductor, or both.

2. Charge injection or impurity migration into the adherent surface of the photoconductor has been particularly limiting for a-Si:H photoconductors formed onto many conductive substrates. In the prior art, thin blocking or barrier layers are commonly deposited on the substrate surface prior to formation of the a-Si:H photoconductor; both electrically insulating and less reactive conductive materials have been used. Yet another approach has been to use the a-Si:H photoconductor as a charge-generation layer and couple it with another layer which acts as a charge-transport layer. These multilayered photoreceptors are complicated to process, costly to produce, and still require a-Si:H layers at least 10 (and typically 20 to 50) micra thick to achieve practical surface potentials at toning; in addition they are inflexible and difficult to manufacture in the large formats required for electrophotographic applications such as analog or digital color proofing.

3. Electrophotographic properties of a-Si:H photoconductors degrade on exposure to environmental humidity or to reactive species present during charging. This sensitivity is thought to originate in unsatisfied dangling bonds on the surface of the a-Si:H photoconductor, as well as on surfaces of internal structural inhomogeneities accessible to active species. In the prior art, such sensitivity has been decreased by overcoating the a-Si:H photoconductor with a thin (of the order of 10 to 200 nm thick) electrically insulating topcoat such as silicon nitride, silicon carbide, or silicon dioxide; however, such prior-art topcoatings add cost, typically require a separate deposition step, and may give rise to an undesirable residual voltage unless kept ineffectually thin.

These disadvantages typify prior-art a-Si:H photoconductors prepared by either silane-based glow discharge or reactive sputtering based on admixed hydrogen in the sputtering atmosphere. Both preparative methods have been used to deposit prior-art a-Si:H photoconductors onto metal substrates, usually at substrate temperatures of 250° C. or greater. Glow-discharge methods have yielded the best prior-art a-Si:H photoconductors, but deposition rates are low and even further limited if dark resistivities of the order of $10^{10}$ ohm·cm are to be obtained. In addition, damaging reactions between process gases and plastic substrates preclude deposition of a-Si:H photoconductors onto such substrates by glow discharge methods.

Sputtering methods can achieve deposition rates several times greater than are currently available by glow-discharge processes and thus promise greater commercial utility. Unfortunately, the a-Si:H photoreceptors prepared by prior-art radio-frequency (RF) reactive-sputtering practices suffer especially from the above-listed disadvantages, and it is known that a-Si:H photoreceptors sputter-deposited at substrate temperatures below about 250° C. have particularly poor properties and stability. At such substrate temperatures, sputtering conditions favor several mechanisms considered to be deleterious to a-Si:H photoreceptor performance:

1. Both the density and refractive index of such a-Si:H photoconductors are notably less than that for crystalline silicon, both decreasing as the substrate temperature at deposition is decreased. It is widely accepted that these effects are due to both formation of microvoids in the photoconductor and segregation of electronically detrimental non-monohydrides and contaminants on the surfaces of such voids.

2. Bonding of hydrogen in non-monohydride modes is favored, with probable concentration in the voids and attendant instability in photoconductor properties.

3. Prior-art a-Si:H photoreceptors formed at substrate temperatures of less than about half of silicon's melting temperature are known to exhibit scanning electron microscope (SEM)-resolvable columnar growth structure 10 to 100 nm in diameter; the columns are separated by interstices due to incomplete coalescence of nucleation islands. Columnar interstices originate at the substrate and propagate through the photoconductor thickness. They not only decrease photoconductor density and refractive index, but also act as segregation surfaces, and serve as diffusion channels for reactive species, so degrading photoconductor properties through increased environmental sensitivity. Such interstitial effects can dominate bulk properties of the columns, particularly in thin layers, and are widely thought to account for the poor electrophotographic performance of prior-art photoreceptors incorporating a-Si:H photoconductors. These effects are particularly limiting if the photoreceptor comprises a thin a-Si:H layer deposited onto a conductive substrate.

To solve the first two above-listed disadvantages of prior-art a-Si:H photoconductors, a novel photoconductor and method of making the photoconductor is found in the above cross-referenced related application which is herein incorporated by reference. In the related application, the first two above-listed disadvantages of prior-art a-Si:H photoreceptors are overcome through use of novel substrate bias conditions and by controlling hydrogen incorporation during formation of the photoconductor in radio-frequency diode reactive sputtering apparatus, whereby an a-Si:H photoconductor is deposited directly onto a conductive substrate without the intermediate charge-injection blocking or barrier layers of prior-art a-Si:H photoreceptors.

Useful electrophotographic properties are attained for photoconductor thicknesses on the order of one micron, at deposition rates of approximately one micron/hour. Deposited to thicknesses of five micra or less, the new photoconductor yields photoreceptors which exhibit a long dark decay $\tau_D$, good charge acceptance $V_0$, and good panchromatic photosensitivity. The new a-Si:H photoconductors attain their significantly greater dark decay with neither the doping nor the alloying used to improve dark resistivities of prior-art a-Si:H photoconductors, but if desired may be doped to provide bichargeable characteristics. Moreover, It has been found that an a-Si:H photoconductor having the required spatially-uniform long dark decays $\tau_D$ can be made at substrate temperatures between 80° C. and 200° C., more preferably between 100° C. and 180° C., with little dependence of the photoconductive properties on deposition temperature within this range. These photoconductors do not demonstrate the marked columnar microstructure typical of prior-art a-Si:H photoconductors formed at substrate temperatures below 250° C., but instead demonstrate a homogeneous glass-like appearance when examined by scanning electron microscopy (SEM).

In contrast to prior-art a-Si:H photoconductors, the new photoconductor contains less than 5% and preferably less than 4% total hydrogen, and due to reduced diffusion of hydrogen at the low formation temperatures, the distribution of hydrogen is more uniform throughout the thickness of the photoconductors than in prior-art a-Si:H photoconductors. The a-Si:H layers contain less than 7% and preferably less than 6% implanted argon, are strongly adherent to the deposition substrate, and provide flexible dopable photoreceptors which can be readily produced in square-meter formats.

The photoreceptor can comprise flexible substrates of metal or plastic provided with a conductive layer, to either of which the new a-Si:H photoconductor is strongly adherent. Due to the low temperatures used in the new method, plastic substrates supporting a conductive or ohmic layer are substantially unaffected by the a-Si:H deposition process. When flexible metallic substrates are used, such photoreceptors may be made by a single deposition process. Deposited onto flexible metallic substrates, such photoconductors demonstrate excellent durability and yield high-resolution, high-quality images useful in various electrophotographic applications such as printing, plate making, duplicating, or color proofing, among others. The photoreceptors are usable over many operational cycles.

A specific example of such a photoreceptor is a bias-sputtered a-Si:H photoconductor five micra or less in thickness, formed onto a conductive substrate with or without an insulating topcoat, as will be referred to hereinafter. In ambient relative humidities below about 40%, such new a-Si:H photoreceptors demonstrate spatially uniform electrophotographic properties of broad commercial potential, and the photoreceptors yield high-resolution, high-quality images when used with imaging processes and liquid toning systems compatible with cadmium sulfide photoreceptors.

However, the new a-Si:H photoreceptors have in common with prior-art a-Si:H photoreceptors the above-listed third disadvantage, a spatially nonuniform charge acceptance and toning response when corona charged under conditions of high ambient humidity. Empirical evidence indicates that this environmental sensitivity originates when water vapor and ions generated from the air under the influence of the corona are absorbed and interact with incomplete bonds on the photoconductor surface, to constitute pathways for leakage of the surface charge. As noted in the prior-art, such environmental sensitivity has been decreased by electrically insulating the active surface sites from the ambient environment by physically top coating the a-Si:H with a thin layer (of the order of 10 to 200 nm thickness) of a dielectric material such as silicon nitride, silicon carbide, or silicon dioxide. However, unless these dielectric top coats are kept thin, their thickness allows three-dimensional electric field gradients to be established which degrade the resolution of the charge (and therefore the reproduced) image. In addition, the prior-art topcoatings add cost due to expensive process materials and decreased process yields, require a separate deposition process in capital-intensive equipment, and can also give rise to an undesirable residual voltage unless they are kept thin (of the order of 5 to 15 nm thickness). The effectiveness of such insulating topcoats as barriers to humidity and reactive species, however, is greatly diminished when they are kept acceptably thin.

It is thus desirable to provide an a-Si:H photoreceptor, with or without an insulating topcoat, having improved environmental stability. It is preferred that the active surface bonds on the a-Si:H photoconductor be chemically completed at the molecular level, rather than electrically insulated from the environment as in the prior art, so that the photoconductor surface retains a functional charge despite presence of water vapor and ions generated by corona charging.

SUMMARY OF THE INVENTION

In view of the foregoing discussion, an object of the invention is to provide an environmentally stable amorphous silicon:hydrogen photoreceptor member comprising an a-Si:H photoreceptor member having a working surface which has been treated with a silanol solution, and heated at approximately 100° C. to 140° C. for 3 to 10 minutes such that said working surface retains spatially uniform electric-field strengths $E \geqq 10$ volts/micron across the thickness of the photoconductive layer for at least two minutes when charged under ambient relative humidity greater than 40%.

Another object of this invention is to provide a method of enhancing the environmental stability of an amorphous silicon:hydrogen photoreceptor member comprising providing an a-Si:H photoreceptor member having a working surface; modifying said surface with a silanol solution; and heating said surface at approximately 100° C. to 140° C. for 3 to 10 minutes; such that said working surface has a decreased sensitivity to ambient environment during charging.

The invention and its advantages will be better understood from the ensuing description of preferred embodiments, reference also being made to the accompanying drawings.

DETAILED DESCRIPTION OF PREFERRED EMBODIMENTS

Figure 1:
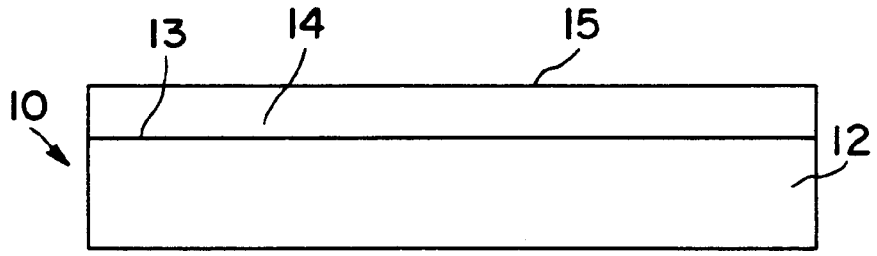
FIG. 1 is a schematic cross-sectional view of a bilayer photoreceptor embodying the present invention.

This invention provides an improved a-Si:H photoreceptor having decreased sensitivity to the ambient environment during corona charging. More specifically, the photoreceptors retain spatially uniform electric-field strengths $E \geqq 10$ volts/micron across the thickness of the photoconductive layer for at least two minutes when corona charged under ambient relative humidity greater than 40%. It is preferable that the photoreceptors retain said field strengths when so charged under ambient relative humidity between 60% and 80%.

It has been discovered that the electrophotographic performance of a-Si:H photoreceptors can be improved so that the quality of their high-resolution imagery does not deteriorate under conditions of high environmental humidity. This improvement comprises chemically modifying the exposed surface of the a-Si:H photoreceptor through exposure to a silanol-rich prepolymer solution, hereinafter referred to as a silanol solution. As a result of exposure to the silanol solution, and subsequent heat treatment, the photoreceptor's exposed surface develops a film of siloxane, which enhances the durability, lubricity and scratch resistance of the photoconductor's working surface. It has been found that upon corona charging, the a-Si:H photoconductive layer of the modified photoreceptor does not exhibit significant lateral electrical field gradients, despite the ambient humidity in which the charging is done, and there is no degradation of the photoreceptor performance due to the film thickness or smoothness variations. Therefore, no spatially variant image degradation in the toned or reproduced image is introduced by the surface treatment, and the ability of the photoreceptor to transfer acceptable images under conditions of high ambient relative humidity are significantly improved.

Preferably, the a-Si:H photoreceptors are annealed at 120° C. for a period of one to three days prior to treatment with the silanol solution.

The silanol solution is formed by hydrolysis of organosilanes. The suitable organosilanes have a molecular formula of $R_n\ Si\ X_{(4-n)}$, wherein R is a nonhydrolyzable organic radical; X is a hydrolyzable group, such as alkoxy with 1 to 4 carbons, phenoxy, acyloxy, or amine; and n=1, 2, or 3. The X groups need not be identical. In the preferred embodiment, R is an octadecyl radical $(CH_3(CH_2)_{17})^-$; n is 1; and the three X groups are the alkoxy groups derived from simple $C_1$ to $C_3$ alcohols, such as methanol or ethanol.

As has been indicated, there can be one to three (n=1, 2, or 3) labile X groups attached to the Si of the organosilane, and the number can be varied to achieve control over the molecular thickness of the surface-modification. Typically, monoalkoxysilanes form monomolecular layers or incomplete monomolecular layers with consistent stoichiometry (according to the concentration of surface sites) when formed from aqueous alcohol solutions, whereas dialkoxysilanes and trialkoxysilanes are less predictable and tend to form multimolecular layers. Similarly, it is known that the number of active surface sites can be reduced, and therefore the surface density of siloxane linkages, by annealing at temperatures above 120° C. For a-Si:H photoreceptors of present interest, use of trialkoxysilanes yields working photoconductor surfaces with imaging resolution indistinguishable from untreated photoreceptors, plus durable working surfaces, and the additional cost of the monoalkoxysilanes or dialkoxysilanes or of annealing at higher temperatures is not justified.

After the preferred annealing step, the a-Si:H photoreceptor is either continuously flooded by recirculating the silanol solution over it or immersing it with gentle agitation in the solution for a time period effective to enable the bonding of the silanol monomer to the photoreceptor. The time period will usually be in the range of 1 to 30 minutes, preferably from 5 to 20 minutes.

Following exposure to the silanol solution, the photoreceptor is rinsed with water to remove vagrant oligomers, formed during condensation of the silanol monomers but unattached to surface sites on the photoconductor.

The photoreceptor is then heat treated. The heat treatment is necessary to obtain decreased sensitivity to humidity. Ambient evaporation at room temperature of the silanol solution on the a-Si:H photoreceptor does not produce the same results obtained with the heat treatment. The heat treatment is typically 100° C. to 140° C. for a time period preferably in the range of three to ten minutes. One example of a suitable heat treatment was 120° C. for five minutes.

The method of the present invention requires no expensive materials and is simple and non-critical, permitting it to be readily carried out manually where volume does not justify investment in equipment. However, in volume applications it may be desirable to provide an automated system for implementing the treatment process appropriately to the specific photoreceptor. Such a system may preferably consist of an agitating process bath, a rinse station, and a vented oven, each appropriate to the geometry of the particular photoreceptor, through each and between which a suitable mechanism transports the photoreceptor according to the chosen timing cycle. The system would also serve to renew the treatment on photoreceptors which had electrophotographic properties that were degraded through use-wear on the photoconductor surface. This simple treatment system is in distinct contrast to the capital-intensive, dedicated equipment need to produce the prior-art top coats until now used to stabilize a-Si:H photoreceptors.

In order to achieve complete coverage of a particular photoconductor surface with low residual hydrophilic silanols, it is necessary to empirically adjust the silane concentration in the silanol solution to provide an effective treatment as evidenced by imaging performance. By reducing availability of active sites on a-Si:H photoconductors to degrading species in the operating environment, treatment with the silanol solution permits the photoreceptor to accept and hold useful charging, which enables the a-Si:H to perform as a stable high-resolution photoconductor at high relative humidities.

One preferred source of a suitable silanol solution is a proprietary product sold under the trade name of GLASSCLAD® 18 by United Chemical Technologies, Inc. (2731 Bartram Road, Bristol, Pa. 19007). According to the manufacturer, GLASSCLAD® 18 is a 20% solution of monomeric octadecylsilane derivative in t-butanol and diacetone alcohol. The alkylsilane reacts with water to form a solution of silanol-rich prepolymer in alcohol.

The GLASSCLAD® 18 is mixed with sufficient water, preferably demineralized and free of fluoride ions, to yield a working silanol solution preferably containing 1.0% to 5.0% by weight of the alkylsilane. For example, a 2% silanol solution is prepared by adding 10 parts by weight of GLASSCLAD® 18 composition to 90 parts of demineralized tap water while stirring the mixture.

While not desiring to be bound by any theory of the invention, hydrolysis of the labile groups from the organosilane in the silanol solution are thought to produce reactive monomeric silanol radicals which are unstable and which condense with themselves to form oligomers. It is presently believed that some incomplete Si bonds on the surface of the photoconductor attach hydroxy groups from atmospheric water, thereby forming surface silanols. When the photoconductor is exposed to the silanol solution, hydrogen bonding occurs between the oligomers and the attached hydroxy groups on the surface of the a-Si:H photoconductor. Preferably this process is carried out so that condensation on the surface silanols is favored; lateral condensation is desirable and is aided by gentle agitation of the photoreceptor in procedures incorporating immersion. During heat treatment, the hydrogen bonds between oligomers and surface silanols are converted to covalent linkages, with concomitant loss of water. At the interface, there is usually only one bond from the silicon of each silanol radical to the photoconductor surface.

The modified surface of a-Si:H photoreceptors treated by the inventive method provide several advantageous properties which were previously difficult to obtain:

1. The electrophotographic properties of the treated a-Si:H photoreceptors are unaffected by relative humidities up to about 80%, whereas such properties of untreated a-Si:H photoreceptors begin to deteriorate at relative humidities of about 40%;
2. Because of the high electrical resistivity (typically greater than $10^{13}$ ohm·cm) of the molecular film, no degradations in the dark resistivity of the a-Si:H photoconductor are introduced by the surface treatment;
3. No residual photoreceptor voltages are introduced by the surface treatment;
4. Because the a-Si:H surface is chemically modified by the formation of a uniform molecular film, no significant electrical-field gradients due to variation in film thickness or smoothness, and therefore no spatially variant image degradations in the toned or reproduced image, are introduced by the surface treatment;
5. The molecular film is stable under exposure to chemicals commonly used in electrophotographic processes;
6. The durability, lubricity, and scratch resistance of the photoconductor working surface are enhanced by the surface treatment; and
7. The surface treatment can be repeated, to recondition photoreceptors whose surface treatment have become damaged or worn through extensive use, by simply retreating the photoreceptor whereby the affected area is repaired.

To practice the present invention, the method hereinafter described is used to chemically modify the working surface of an a-Si:H photoconductor, either doped or undoped and preferably formed directly onto a conductive substrate without intermediate blocking or barrier layers. Optionally, the photoreceptor can be provided with an inorganic insulating topcoat. Examples of photoreceptors which benefit from the application of the silanol solution are provided in the cross-referenced patent application, which is herein incorporated in its entirety by reference, and in the following embodiments.

Photoreceptor Embodiment 1

With reference to FIG. 1, a first embodiment of an a-Si:H photoreceptor incorporating the present invention is designated generally by the reference numeral 10. The photoreceptor 10 comprises a substrate 12 having a conductive surface 13 and a photoconductive layer 14 of a-Si:H formed onto conductive surface 13. Substrate 12 may be any structure suited to a given electrophotographic application and may be made of either an electrically conductive material having an inherently conductive surface 13 such as a stainless-steel sheet or a nonconductive material provided with an electrically conductive layer forming surface 13 such as a Mylar® film provided with a conductive layer selected from the group consisting of alloys of aluminum, chromium, iron, molybdenum, nickel, and tungsten; and ohmic oxides. Conductive surface 13 must be smooth and free of defects or flaws to the degree consistent with the desired electrophotographic resolution, and it is preferred that surface 13 be a clean, nonreactive surface.

The a-Si:H photoconductive layer 14 may be formed in a conventional manner by, e.g., silane-based glow discharge or reactive sputtering based on admixed hydrogen in the sputtering atmosphere.

However, a-Si:H photoconductive layer 14 is preferably formed directly onto conductive surface 13 of substrate 12 to a thickness of five micra or less using bias RF reactive sputtering as described in the above cross-referenced related application, and this will be the photoreceptor referred to hereinafter, unless otherwise specified. A specific example of such a photoreceptor is a bias-sputtered a-Si:H photoconductor layer 14 on the order of one micron in thickness deposited onto a stainless-steel substrate 12, with or without an insulating topcoat as will be discussed. The optical bandgap of such photoconductive layers, and therefore the density of thermally generated carriers, can be controlled over the range between 1.7 eV and 2.1 eV by regulating the ratio ($P_H/R_{Si}$) of the partial pressure of hydrogen ($P_H$) in the sputtering atmosphere to the a-Si:H deposition rate ($R_{Si}$) during formation of the photoreceptors. The drift mobilities of free charge carriers in the photoconductive layer can be decreased, by controlling the substrate bias conditions, to provide a carrier mobility·lifetime product of at least $10^{-10}$ $cm^2$/volt. Through controlling both the density and mobility of the thermally generated carriers in the photoconductive layer, dark resistivities greater than $10^{13}$ ohm·cm are readily achieved, with correspondingly long charge retentions and dark decays $\tau_D$. Such photoreceptors have charge acceptances $V_0 \cong -40$ volts and at ambient relative humidities of 40% or less can maintain dark electric field strengths E>10 volts/micron between the outer surface 15 and conductive surface 13 for over 100 seconds. Preferably the electric field strength will be E>10 volts/micron for over 200 seconds.

When a-Si:H photoreceptors 10 are formed by said method onto clean, nonreactive substrates 12, long dark decays are readily attained without need for intermediate charge-injection blocking or barrier layers. However, some substrate materials may result in excessive charge-injection effects or in migration of impurities from the surface 13 into the a-Si:H layer during the sputtering process or during use, with consequent degradation of photoreceptor response or spatial uniformity. For example, both copper and gold are known in the art to result in poor photoreceptor performance when used as substrates, while aluminum alloys might give less consistent performance than alloys containing various amounts of chromium, iron, molybdenum, nickel, or tungsten. If less-preferable materials are used as photoreceptor substrate 12, blocking or barrier layers of the many types known in the art may be applied to substrate surface 13 prior to the formation of the a-Si:H photoconductive layer 14. However, it is preferable that nonreactive substrates be used, and stainless steels are preferred for their functionality, low cost, and ready availability. With a preliminary cleaning to remove surface contaminants and a presputtering period in the process reactor to prepare an atomically clean surface, the stainless steels form rugged flexible substrates to which the photoconductive layer is strongly adherent.

For large-format photoreceptors such as are used in color proofing, surface 13 is preferably one surface of a thin stainless-steel sheet of appropriate lateral dimensions, said sheet forming substrate 12. Type 301 stainless steel 0.1 mm thick and Type T430 stainless steel 0.125 mm thick have both performed well as substrate materials when provided with mirror finishes. Other large-format applications may benefit from use of a Mylar® polyester film provided with a suitable conductive thin layer (e.g., of a non-reactive metal such as chromium or of a transparent ohmic oxide of indium or tin or combinations thereof) comprising surface 13; such layer may be either formed as a preliminary step while the plastic substrate is in the sputtering apparatus or as a separate precursor step by any of the methods known in the art. Photoreceptor substrates for smaller-format applications can be rigid or non-planar, and as known in the art, a wide variety of materials and geometries can be adapted to use as substrates.

The a-Si:H photoconductive layer 14 is preferably formed directly onto conductive surface 13 of substrate 12 to a thickness of five micra or less using bias RF reactive sputtering as described in the above cross-referenced related application. Most preferably, photoconductive layer 14 is formed to a thickness between 0.3 micron and 3 microns. A photoconductor thickness of approximately one micron provides a reasonable compromise between maximizing energy coupling efficiency and minimizing the volume contribution to the available thermally generated carriers in the photoconductor layer. The optical bandgap of such photoconductive layers, and therefore the density of thermally generated carriers, can be controlled over the range between 1.7 eV and 2.1 eV by regulating the ratio of ($P_H/R_{Si}$) of the partial pressure of hydrogen ($P_H$) in the sputtering atmosphere to the a-Si:H deposition rate ($R_{Si}$) over the approximate range between 2.8 mTorr·hr/micron and 5.8 mTorr·hr/micron during formation of the photoreceptors. The drift mobilities of free charge carriers in the photoconductive layer can be decreased and repeatably controlled, by controlling the substrate bias conditions as stated above, to provide a carrier mobility.lifetime product of at least $10^{-10}$ $cm^2$/volt. Through controlling both the density and mobility of the thermally generated carriers in the photoconductive layer, dark resistivities greater than $10^{13}$ ohm·cm are readily achieved at low ambient relative humidities, with correspondingly long dark decays $\tau_D$. For a-Si:H layers 14, one micron in thickness, deposited at rates of approximately one micron/hour, these photoreceptors have charge acceptances $V_0 \cong -40$ volts and can maintain dark electric field strengths E>10 volts/micron between the outer surface 15 and conductive surface 13 for more than 100 seconds, preferably greater than 200 seconds. Approximate dark surface potentials of −17 volts at 105 seconds after charging have been demonstrated for undoped bilayer photoreceptors comprising a-Si:H layers approximately 1.0 micron in thickness on stainless-steel substrates, or $E_{105} \cong 17$ volts/micron. These significantly greater dark decays are attained without either the doping or the alloying used to improve dark resistivities of prior-art a-Si:H photoconductors. Preferably, a-Si:H photoreceptor 10 is annealed at 120° C. for a period of one to three days prior to treatment with the silanol solution.

Photoreceptor Embodiment 2

As described in the above cross-referenced related application, the a-Si:H photoconductors may be doped to provide bichargeable characteristics, preferably by appropriate introduction of a suitable dopant gas into the sputtering atmosphere during deposition of the a-Si:H photoconductive layer 14. Concentrations of diborane ($B_2H_6$) at levels as low as 0.1 ppm substantially increase the bichargeability of the new a-Si:H photoreceptors. Depending on the desired characteristics, concentrations of approximately one ppm to 15 ppm of diborane are preferred. Surface potentials of approximately −14 volts at 105 seconds after charging have been demonstrated for doped bilayer photoreceptors comprising a-Si:H layers approximately 1.0 micron in thickness, or $E_{105} \cong 14$ volts/micron. As appreciated by those skilled in the art, gases containing other elements, from the IIIA or VA groups of the periodic table of elements, can also be used. One such example is a gas containing phosphorous. If less-preferable materials are used as photoreceptor substrate 12, blocking or barrier layers of the many types known in the art can be applied to substrate surface 13 prior to the formation of the a-Si:H photoconductive layer 14. Preferably, a-Si:H photoreceptor 10 is annealed at 120° C. for a period of one to three days prior to treatment with the silanol solution.

Photoreceptor Embodiment 3

Figure 2:
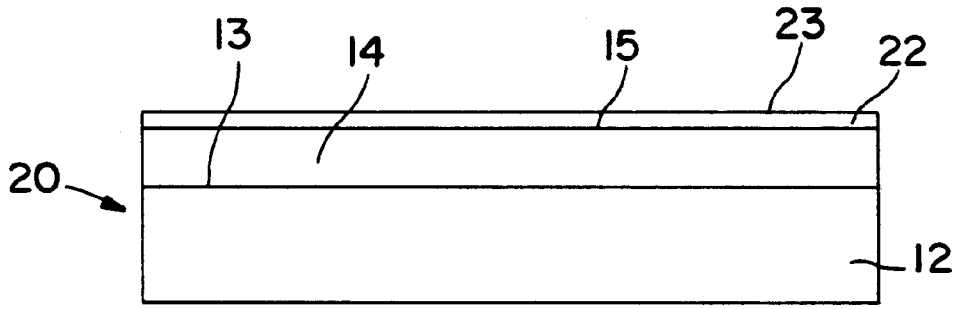
FIG. 2 is a schematic cross-sectional view of a photoreceptor with a topcoat embodying the present invention.

The use of insulating topcoats has been found to improve the charge retention (dark decay) characteristics of the photoreceptor. Referring to FIG. 2, another embodiment of an a-Si:H photoreceptor is designated generally by the reference number 20. Photoreceptor 20 includes the substrate 12 having a conductive surface 13 and the a-Si:H layer 14 having outer surface 15 as before. Photoconductive layer 14 may be either undoped or doped, as described in the first and second preceding embodiments, respectively. If less-preferable materials are used for photoreceptor substrate 12, blocking or barrier layers of the many types known in the art may be applied to said substrate prior to the formation of the a-Si:H photoconductive layer 14.

In this embodiment, an insulating topcoat 22 having an outer surface 23 is deposited onto surface 15. Topcoat 22 formed on surface 15 may be any of the dielectric materials known in the topcoat art, formed either as a secondary step while the photoreceptor 20 is in the sputtering apparatus or by other methods known in the art. Topcoat layer 22 is preferably one of the silicon dielectrics such as, e.g., silicon nitride, silicon dioxide, or silicon carbide; in addition to serving as a barrier layer to reactive species from the environment, some of these provide increased charge acceptance or retention. However, insulating topcoat 22 may cause undesirable residual voltages on surface 23 following photo-induced discharge if formed to a thickness of more than about 20 nm. Topcoats 22 on the order of 8 nm to 10 nm in thickness appear to be most effective in improving charge retention characteristics without giving rise to undesirable residual voltages on surface 23. Surface potentials of approximately −28 volts at 105 seconds after charging have been demonstrated for photoreceptors comprising undoped a-Si:H layers approximately 1.0 micron in thickness ($E_{105} \cong 28$ volts/micron), while surface potentials of approximately −24 volts at 300 seconds after charging have been attained for photoreceptors comprising doped a-Si:H layers approximately 1.4 micron in thickness, each topcoated with silicon nitride 10 nm in thickness. Preferably, a-Si:H photoreceptor 10 is annealed at 120° C. for a period of one to three days prior to treatment with the silanol solution.

Photoreceptor 10 in FIG. 1 or photoreceptor 20 in FIG. 2 when formed according to the method of the cross-referenced related application provides excellent electrophotographic properties and yields high-quality images when utilized at low relative humidities (25% or less) with the color proofing system described in U.S. Pat. Nos. 4,358,195 and 4,556,309. In common with prior-art a-Si:H photoreceptors, photoreceptor 10 in FIG. 1 and photoreceptor 20 in FIG. 2 have an outer exposed surface 15 which without further treatment is environmentally unstable under high humidity conditions. Consequently, with relative humidities of 40% or greater, the electrophotographic properties of these photoreceptor are significantly modified and appear to degrade more or less proportionally to the increase in relative humidity. In ambient relative humidities below about 40%, the charge acceptance and retention of photoconductor layer 14 in FIG. 1, measured between surfaces 13 and 15, is spatially uniform; at ambient relative humidities of about 40% and higher, outer surface 15 of photoconductor 14 demonstrates spatially nonuniform charge acceptance and retention characteristics, resulting in significant degradation of the photoreceptor dark decay and toning response manifested as spatially erratic electrophotographic behavior. For thin topcoats 22 in FIG. 2, photoconductor 14 demonstrates a similar sensitivity to the operating environment. The adverse effects of high relative humidity do not appear to be permanent. Once photoconductor 14 in FIGS. 1 or 2 has equilibrated with a relative humidity below about 40% in the operating environment, the original high-quality electrophotographic properties of the photoreceptors are restored.

Regardless of the particular photoreceptor embodiment, surface 15 in FIG. 1 or surface 23 in FIG. 2 can be environmentally stabilized by treatment according to the present invention. For example, the clean annealed photoreceptor 10 in FIG. 1 (or photoreceptor 20 in FIG. 2) is immersed in a 2% silanol solution (prepared by adding 10 parts by weight of GLASSCLAD® 18 to 90 parts of demineralized tap water while stirring the mixture), preferably for a time period in the range of one to thirty minutes. Following immersion, surface 15 (or surface 23) is rinsed with water to remove excess silanol solution and vagrant oligomers. Although some chemical modification of surface 15 (or surface 23) occurs if the treated photoreceptor is allowed to dry at room temperature for one to two days, preferably the treated photoreceptor is heat-treated in a temperature range of 100° C. to 140° C. for a time period in the range of three to ten minutes, for example 120° C. for five minutes. The treated a-Si:H photoreceptor 10 (or photoreceptor 20) is then ready for use.

Prevailing conditions during testing of photoreceptors having long dark decays can substantially affect the results obtained. To compare the electrophotographic properties of treated a-Si:H photoreceptors with those of identical non-treated photoreceptor samples, a cycle-testing system was modified to permit control of the relative humidity within the light-tight test chamber. The humidity in the cycle-testing chamber was regulated by two flow meters, one supplying dry air while the second supplied air saturated with water vapor by bubbling ambient air through a water bottle. A humidity probe, positioned inside the light-tight cycle-tester chamber, was used to record the test humidity on a chart recorder. The chamber contained a motor-driven rotating drum surrounded by various functional stations. These stations included a coratron to charge the photoreceptor surface to a predetermined surface potential, an electrostatic voltmeter head (Monroe probe) to sense the surface potential of the photoreceptor, and tungsten light sources to discharge the photoreceptor. A coratron power supply and an electrostatic voltmeter to measure the surface potential of the photoreceptor under test were located external to the light-tight chamber. Photoreceptor charging in negative polarity was typically done with a coratron comprising a HCL negative corona assembly operating with a 1.2-cm shielded gap, at a charging current of −225 $\mu$a through the photoreceptor under test, while the photoreceptor was caused to make one pass by the coratron gap at a velocity of 7.6 cm /second. Cross-web surface potentials were recorded over time with the electrostatic voltmeter and a chart recorder.

Test strips were cut from bias-sputtered a-Si:H photoreceptors formed as described in the above cross-referenced related application. Test strips included ones from photoreceptors doped with boron during the deposition process, post-deposition topcoated with silicon nitride, or both doped and topcoated. After the test strips were annealed at 120° C. for a period of one to three days, one-half of each test strip was immersed in a 1.0% to 5.0% water solution of GLASSCLAD® 18 for a period of one to thirty minutes. The samples were then rinsed under running water and placed in a laboratory oven at 120° C. to cure for five minutes. There was no visible indication of the treatment on the photoreceptor test strips.

Each photoreceptor test strip was attached to the drum in the cycle-testing system, where its working surface was sequentially corona charged, its surface potential monitored and recorded, and then exposure discharged by the several tungsten lamp stations surrounding the drum. Single and multiple cycles were performed on the test strips under various humidity conditions. Surface potential profiles were recorded at time intervals of 10 seconds ($V_{10}$) and 105 seconds ($V_{105}$) after corona charging (the 10-second interval was the shortest conveniently available with drum speeds of the cycle-testing system, and the 105-second interval was chosen to match the charging-toning interval of the proofing system to be used in image tests). Cycling procedures were conducted for various time periods, with a 5-minute delay between cycles.

Figure 3:
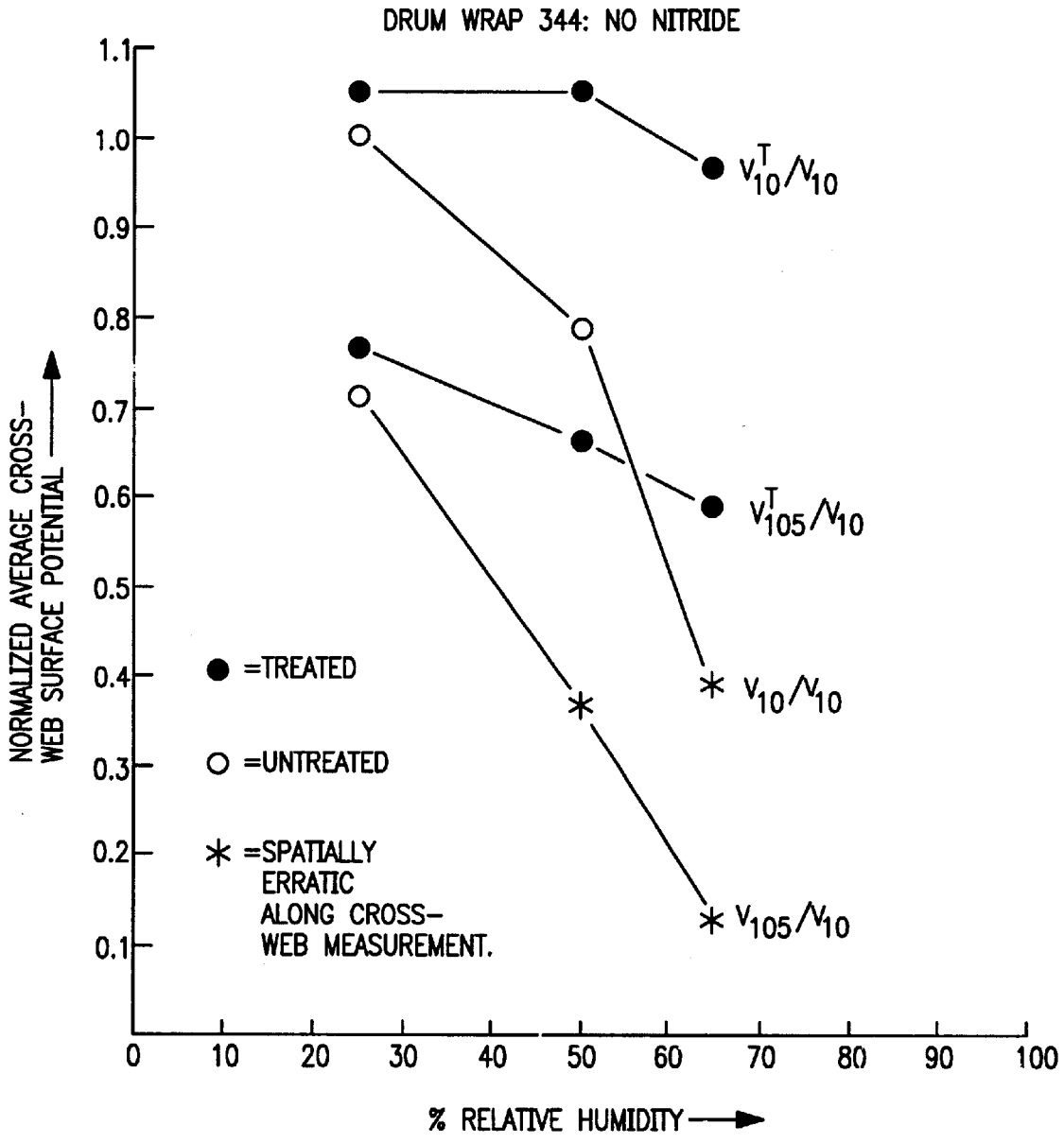
FIG. 3 is a graph illustrating comparative test results for a representative photoreceptor according to Photoreceptor Embodiment 1.
Figure 4:
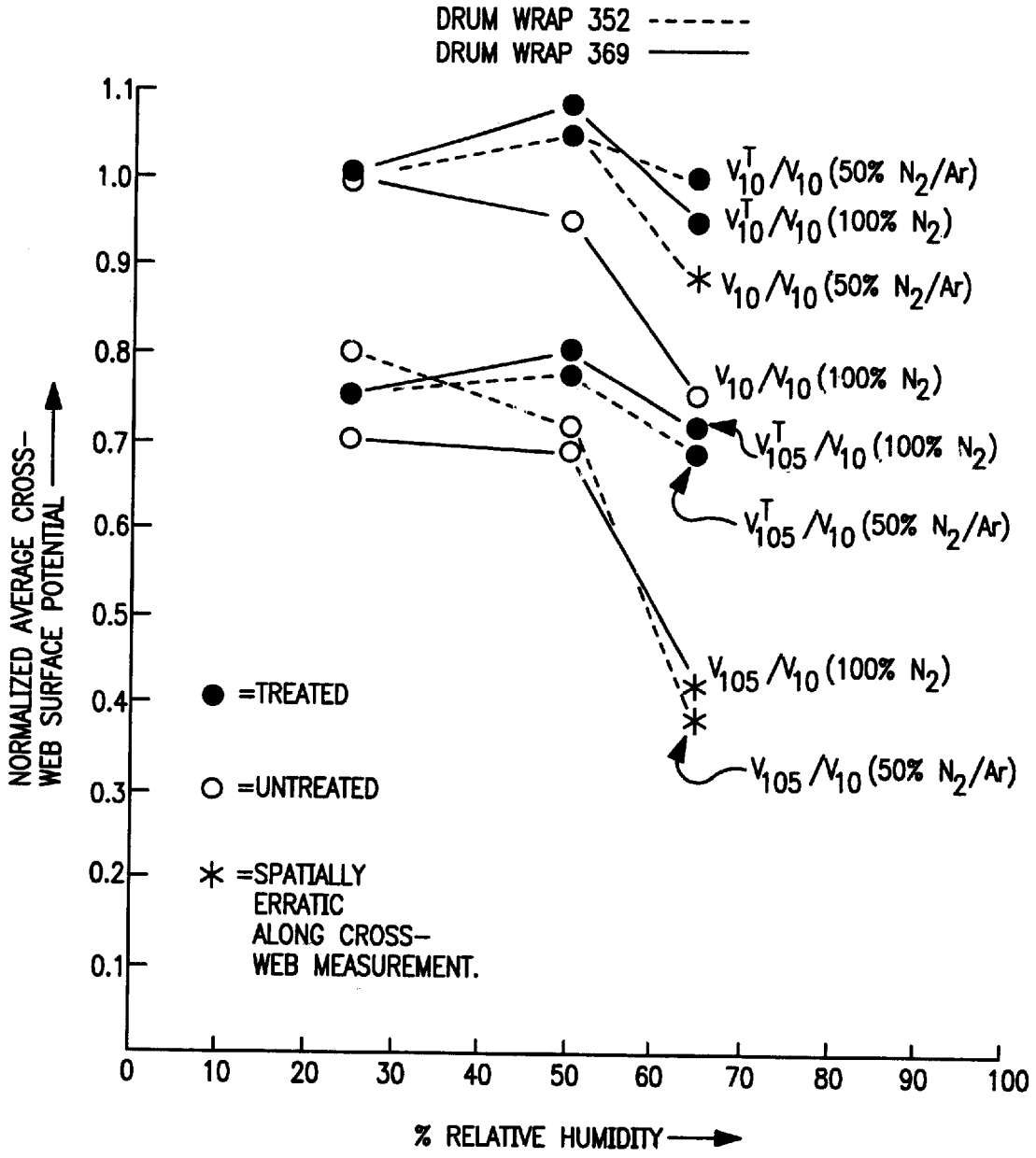
FIG. 4 is a graph illustrating comparative test results for representative photoreceptors according to Photoreceptor Embodiment 3.
Figure 6:
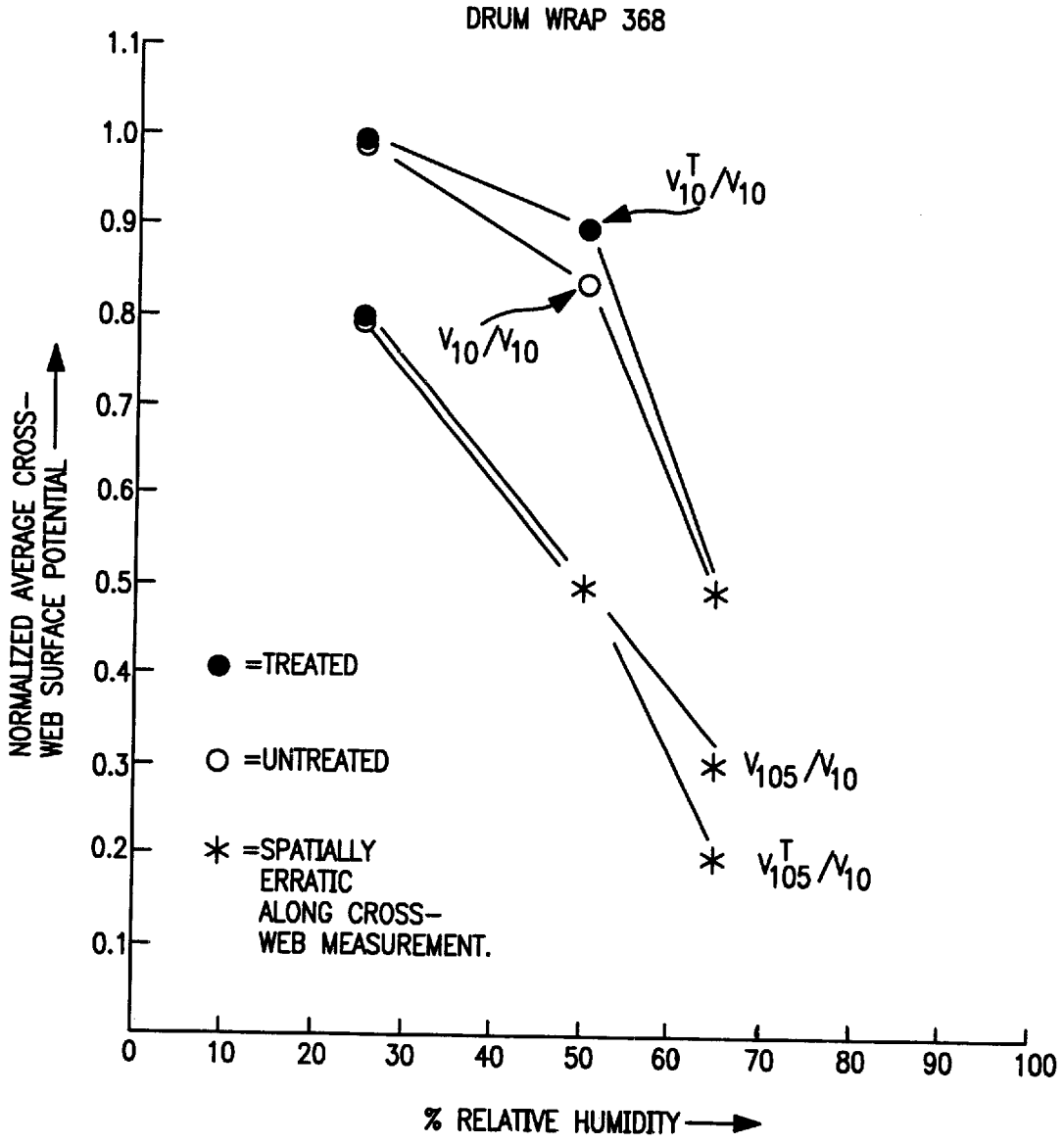
FIG. 6 is a graph illustrating comparative test results for developmental photoreceptors according to Photoreceptor Embodiment 3.
Figure 7A:
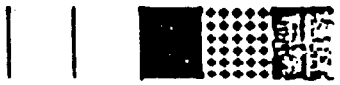
FIGS. 7A and 7B illustrate the image quality resulting from a-Si:H photoreceptors that are either treated (FIG. 7A) or untreated (FIG. 7B) by the method of the present invention and used to transfer a toned image in an ambient atmosphere having 35% relative humidity.
Figure 7B:
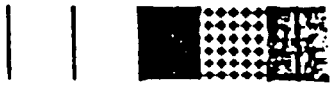
Figure 7C:
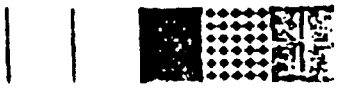
FIGS. 7C and 7D illustrate the image quality resulting from a-Si:H photoreceptors that are either treated (FIG. 7C) or untreated (FIG. 7D) by the method of the present invention and used to transfer a toned image in an ambient atmosphere having 50% relative humidity.
Figure 7D:
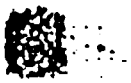
Figure 7E:
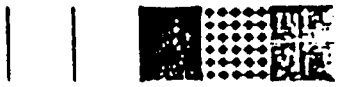
FIGS. 7E and 7F illustrate the image quality resulting from a-Si:H photoreceptors that are either treated (FIG. 7E) or untreated (FIG. 7F) by the method of the present invention and used to transfer a toned image in an ambient atmosphere having 70% relative humidity.
Figure 7F:
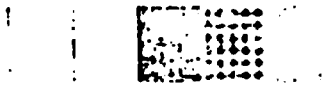

FIGS. 3, 4, and 6 illustrate comparative average cross-web surface potentials, for ambient relative humidity levels of 25%, 50%, and 65%, for a-Si:H photoreceptors made according to several embodiments. Data for the untreated or treated portions of the test strip are indicated by open circles or solid circles, respectively, and symbols representing treated data are given a superscript T, e.g., the average cross-web surface potential at 105 seconds after corona charging for a treated photoreceptor is indicated by $V_{105}^{T}$. The data have been normalized, by dividing each average cross-web surface potential by the average cross-web surface potential at 10 seconds ($V_{10}$) obtained for the untreated photoreceptor. Data points having the open circle replaced by an asterisk (*) represent average cross-web potential measurements for which the cross-web potential plot indicated spatially non-uniform surface potentials unacceptable for imaging.

In FIG. 3 normalized average cross-web surface potentials are presented for a representative photoreceptor made according to Photoreceptor Embodiment 1. For this photoreceptor, the a-Si:H photoconductor was approximately one micron thick, with $V_{10}$=38 volts and $E_{10}$=38 volts/micron. One portion of the test strip was exposed for 60 minutes to a working liquid obtained by diluting GLASS-CLAD® 18 with sufficient demineralized water to contain 5% by weight of the organosilane, rinsed, and heat-treated for 10 minutes at 120° C. The data for both time intervals for the untreated portion of the test strip ($V_{10}/V_{10}$ and $V_{105}/V_{10}$, respectively) illustrate the typical behavior of a-Si:H photoreceptors prepared without an insulating topcoat, the surface potential decreasing with ambient humidity until at 65% relative humidity the 10-second surface potential is only 39%, and the 105-second only 13%, of the value at 25% relative humidity. In contrast, the portion of the photoreceptor treated according to the present invention maintains the slower initial dark decay, indicated by the 105% normalized potential at 10 seconds, over the range of test ambient humidities. Thus, at 10 seconds after charging the treated portion is unaffected by relative humidities of 50% and only falls to 97% at relative humidities of 65%, while at 105 seconds the average surface potential of this portion decreases inversely with relative humidity, to 58% at 65% relative humidity. The treated portion retained a uniform surface potential ($E_{105}$=22 volts/micron) at this ambient humidity despite prolonged exposure to the humid environment, whereas for the untreated portion $E_{105}$=5 volts/micron with unusable potential variation. Based on its behavior over the test range of ambient humidity, the treated portion should provide an average surface potential of approximately 18 volts (E=18 volts/micron) at 80% relative humidity.

In FIG. 4, similar data are presented for two representative photoreceptors made according to Photoreceptor Embodiment 3. For these photoreceptors, the a-Si:H photoconductor was approximately one micron thick and topcoated with approximately 10 nm of silicon nitride formed in an atmosphere containing either 100% nitrogen (solid connecting lines) or 50% nitrogen in argon (dashed connecting lines). Both preparative methods yielded photoreceptors having $E_{10}$=40 volts/micron, and substantially the same response to ambient humidity. One portion of each test strip was exposed for five minutes to a working liquid containing 1% by weight of the organosilane, rinsed, and heat-treated for five minutes at 120° C. according to the present invention. The data for both time intervals for the untreated portion of the test strips ($V_{10}/V_{10}$ and $V_{105}/V_{10}$, respectively) illustrate the typical behavior of a-Si:H photoreceptors topcoated with thin silicon nitride layers, the surface potential decreasing with ambient humidity. In contrast, the surface potential of the treated portion of the photoreceptors increases slightly as ambient humidity increases to 50%, with only a slight decrease at relative humidities of 65%, while at 105 seconds the average surface potential of this portion only varies slightly over the test range of relative humidity. The treated portion retained a uniform surface potential ($E_{105}$=28 volts/micron) at this ambient humidity despite prolonged exposure to the humid environment. In contrast, for the untreated portion $E_{105}$=16 volts/micron, but the surface potential was too non-uniform for electrophotographic application. Based on the observed behavior over the test range of ambient humidity, the treated portion of either photoreceptor could be expected to provide an average surface potential of approximately 24 volts (E=24 volts/micron) at 80% relative humidity. The photoreceptor formed in 100% nitrogen atmosphere gave slightly more consistent response in elevated ambient humidity, but that formed in the 50% nitrogen/argon atmosphere did not require a complete reactor pump-down.

Figure 5:
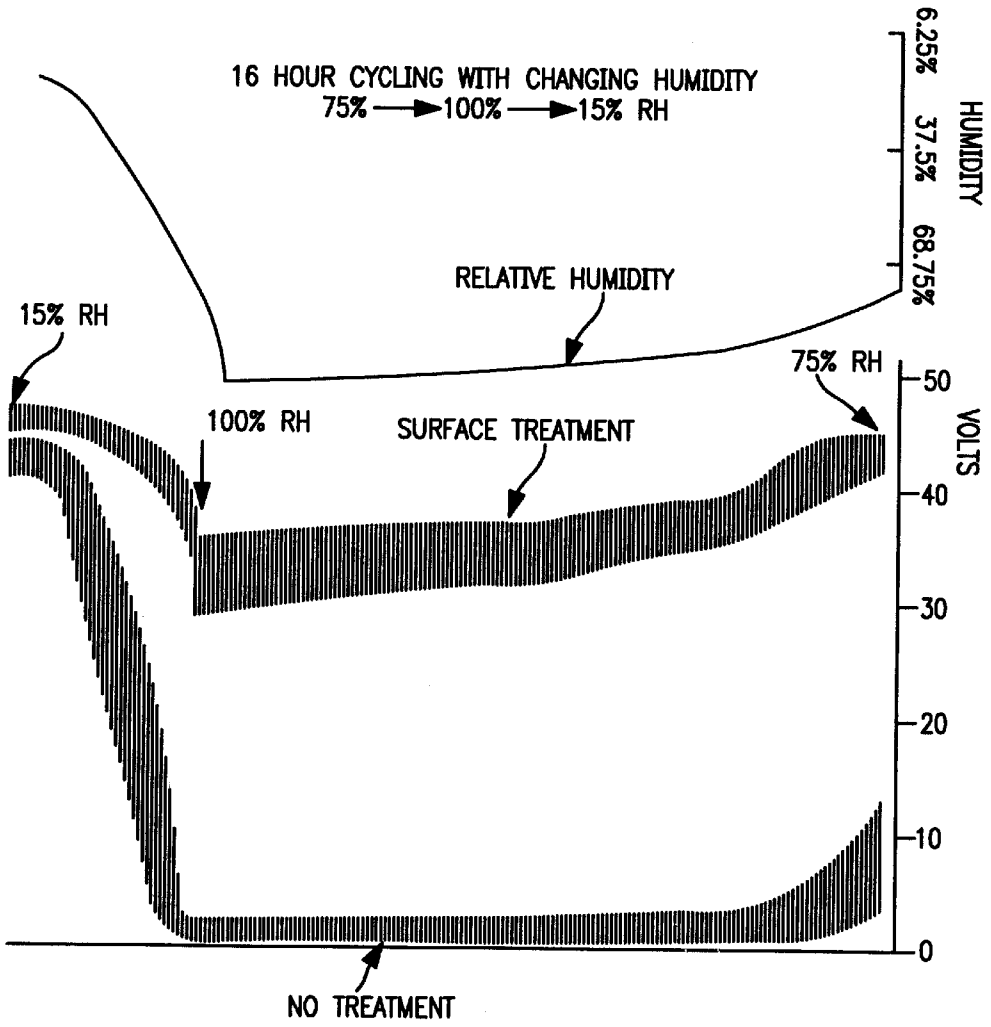
FIG. 5 is a comparative cycle-test plot of surface potential for a representative test strip subjected to 16 hours of cycling, with ambient relative humidity levels increasing from 75% to 100% and then decreasing back to 15%. The time axis increases from right to left.

Both portions of these photoreceptors returned to uniform surface potentials when the ambient was decreased below about 35% to 40% relative humidity, with stable electrophotographic properties both at ambient humidities below this level and over many such humidity cycles. FIG. 5 illustrates the results of such a test in which the test strip was subjected to 16 hours of continuous cycling at five-minute intervals, with the humidity level slowly changing from 75% to 100% relative humidity and then more rapidly back down to 15% relative humidity (in the FIG. the time axis is reversed, with time increasing to the left). The dark band at the top represents average surface potentials $V_{10}^{T}$ of the treated portion while the dark band at the bottom represents average surface potentials $V_{10}$ of the nontreated area of the test photoreceptor; each five-minute cycle is visible as one spike in each of the bands. The drastic decrease in surface potential with humidity for the untreated portion is evident. FIG. 5 also demonstrates the reversible nature of the effect of humidity on the dark decay characteristics of a-Si:H photoreceptors, with complete recovery of surface potential occurring over a period of a few hours once ambient humidity levels were sufficiently decreased.

FIG. 6 contains graphical data similar to those of FIGS. 3 and 4 for a photoreceptor according to Photoreceptor Embodiment 3, treated according to the manufacturer's recommendations for room-temperature use of GLASS-CLAD® 18. The a-Si:H photoconductor was approximately one micron thick and topcoated with approximately 10 nm of silicon nitride formed in an atmosphere containing 50% nitrogen in argon. One portion of the test strip was exposed for five minutes to a working liquid containing 1% by weight of the organosilane, rinsed with water, and allowed to cure for 24 hours at room temperature, at about 45% relative humidity. Although this procedure is within the parameters recommended by the manufacturer for treating glassware, there was no substantial effect on the electrophotographic properties of the a-Si:H photoconductor. For both portions of the test strip, $V_{10}$=50 volts at 25% relative humidity, decreasing to 45 volts at 50% relative humidity; at 65% relative humidity the average $V_{10}$=25 volts, but with unacceptable spatial variation. Similarly, at 105 seconds spatial consistency in surface potential acceptable for imaging was only obtained at ambient humidity levels of 25% relative humidity. Stable properties have been reliably attained only for photoreceptors treated at temperatures above 100° C., although a heat treatment of only a few minutes seems sufficient.

It is presently believed that there are two water-related processes involved in formation of the modified layer on the photoconductor surface: a) evolution of water on formation of covalent linkages from the original hydrogen bonds, and b) physical removal of surface water. While the room-temperature procedure removes surface water, either it does not effectively establish the siloxane linkages or it does not satisfactorily evolve the reaction water, at least to the extent required for stable electrophotographic properties in a-Si:H photoreceptors. While some advantages of the present method can be provided if the pre-treatment annealing is omitted, it is preferred that there be independent annealing and linkage-forming heat treatments.

To illustrate the effectiveness of the inventive method, sample images were made on both treated and nontreated photoreceptors at three ambient relative humidity levels (35%, 50%, and 70%). The photoreceptor was prepared as a plate and tested on the color proofing system of U.S. Pat. Nos. 4,358,195 and 4,556,309 with a toner system optimized for use with cadmium sulfide photoreceptors. This system tones the photoreceptor 105 seconds after corona charging. Results of these tests are shown in FIGS. 7A, 7B, 7C, 7D, 7E, and 7F. At ambient relative humidity levels of 35% there was no significant difference between treated and untreated photoreceptors. There was also little difference in the imaging performance of the treated photoreceptor, regardless of the ambient relative humidity. However, the imaging performance of the untreated photoreceptor was severely degraded for ambient relative humidity levels above about 40%. During these imaging tests the working surface of the photoreceptor was periodically cleaned with Isopar™ (Exxon Corporation) and benzyl alcohol, neither of which degraded the imaging performance of the treated photoreceptor. Butyl alcohol will affect the modified a-Si:H surface, and its use near treated photoreceptors should be guarded. Generally, however, aggressive reagents such as 5% sodium hydroxide, ethanolic potassium hydroxide, or hydrofluoric acid solutions are required to remove the modified working surface.

To evaluate functional durability of the treated photoconductors, extensive use was simulated by repeatedly cycling the photoreceptors through the cleaning rollers of the aforesaid proofing system. In these durability tests the treated photoreceptors showed no significant degradation in surface treatment, as evidenced by degradation in electrophotographic imaging in high ambient humidity, after the equivalent of 1200 proofing cycles.

It is apparent that other organolsilanes, even ones having the $(CH_3(CH_2)_{17})^-$ radical but other X groups, could be used to provide environmentally stabilized a-Si.H photoreceptors. For example, X might be a halogen such as Cl or F, but these form an acidic byproduct which unless completely neutralized or removed produces spatially variant surface charge retention and attendant imaging degradation. However, the effectivity of the inventive method, the simplicity and safety of the treatment process, and the low cost and ready availability of treatment materials provided by the GLASS-CLAD® 18 system are unlikely to be significantly improved upon by a chemical system containing less common or more complex hydrolyzable groups. The excellent electrophotographic performance yielded by the present method exceeds that provided by prior-art methods requiring technically sophisticated processes, equipment, and trained personnel to apply silicon-based insulating topcoats.

The treatment of the present invention as disclosed herein should be optimized (as judged by electrophotographic imaging performance) to the particular a-Si:H formulation being stabilized, and modifications and variations of the inventive method are thus possible in light of the above teachings. However, in all cases, the treatment retains or improves the inherent photoreceptor characteristics in conditions of high ambient relative humidity. It is therefore to be understood that within the scope of the appended claims, the invention may be practiced otherwise than as specifically described.

What is claimed is:

1. An environmentally stable photoreceptor member comprising an a-Si:H photoconductive layer, said photoreceptor member being first annealed for one to three days, then said photoconductive layer being treated with a prepolymer solution, and said photoreceptor member then being heated to a temperature between approximately 100° C. to 140° C. for 3 to 10 minutes to form on said photoconductive layer a working surface having a siloxane film, wherein said prepolymer solution results from reaction of water free of fluoride ions with an organosilane of the formula of $R_nSiX_{(4-n)}$, where R is a nonhydrolyzable octadecyl group, and X is a hydrolyzable group selected from the group consisting of alkoxy groups having one to four carbons, phenoxy groups, acyloxy groups, and amine groups, and n=1, 2, or 3; said prepolymer solution being free from fluoride ions, whereby said photoconductive layer remains amorphous and has a uniform dark resistivity of $10^{13}$ ohm·cm or greater and whereby said photoconductive layer retains spatially uniform electric-field strengths $E \geqq 10$ volts/micron across the thickness thereof for at least two minutes after electrically charging the working surface under ambient relative humidity greater than 40%.

2. The a-Si:H photoreceptor of claim 1, wherein said ambient relative humidity is greater than 60%.

3. The a-Si:H photoreceptor member of claim 1, wherein the ambient relative humidity is 65%.

4. The a-Si:H photoreceptor of claim 1, wherein said working surface has an absence of significant lateral electrical-field gradients due to variation in film thickness or smoothness, and has an absence of spatially variant image degradations in toned or reproduced images.

5. The a-Si:H photoreceptor of claim 1, wherein said working surface has no residual photoreceptor voltage after corona charging and photo-induced discharge of said photoreceptor.

6. The a-Si:H photoreceptor of claim 1, wherein said photoconductive layer thickness is less than 5 microns.

7. The a-Si:H photoreceptor of claim 6, wherein said photoconductive layer thickness is between 0.3 microns and 3 microns.

8. The a-Si:H photoreceptor member of claim 1, wherein the ambient relative humidity is up to about 80%.

* * * * *

UNITED STATES PATENT AND TRADEMARK OFFICE

CERTIFICATE OF CORRECTION

PATENT NO. : 6,300,028 B1
DATED : October 9, 2001
INVENTOR(S) : Marshall D. Graham and Gary L. Dorer It is certified that error appears in the above-identified patent and that said Letters Patent is hereby corrected as shown below:

Column 2,
Line 22, change "has" to -- have --.
Line 37, insert a semicolon after "strates".
Line 59, insert a closing parenthesis after "50".
Line 61, insert a semicolon after "toning".

Column 7,
Line 55, change "n" to -- *n* --.
Line 57, change "n" to -- *n* --.
Line 60, change "n" to -- *n* --.

Column 11,
Line 50, change the period after "mobility" to -- ' --.

Column 13,
Line 4, change "10" to -- 20 --.

Column 17,
Line 28, change "organolsilanes" to -- organosilanes --.

Column 18,
Line 20, change "n" to -- *n* --.

Signed and Sealed this

Fourteenth Day of May, 2002

*Attest:*

*Attesting Officer*

JAMES E. ROGAN
*Director of the United States Patent and Trademark Office*